US012384506B2

(12) United States Patent
Tsurumi

(10) Patent No.: US 12,384,506 B2
(45) Date of Patent: Aug. 12, 2025

(54) SPEED CONTROL METHOD FOR MARINE VESSEL, AND MARINE VESSEL

(71) Applicant: YAMAHA HATSUDOKI KABUSHIKI KAISHA, Iwata (JP)

(72) Inventor: Nao Tsurumi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 246 days.

(21) Appl. No.: 18/136,957

(22) Filed: Apr. 20, 2023

(65) Prior Publication Data

US 2023/0339588 A1 Oct. 26, 2023

(30) Foreign Application Priority Data

Apr. 21, 2022 (JP) ..... 2022-070085

(51) Int. Cl.
*B63B 79/40* (2020.01)
*B63H 21/21* (2006.01)

(52) U.S. Cl.
CPC ..... *B63H 21/21* (2013.01); *B63B 79/40* (2020.01); *B63H 2021/216* (2013.01)

(58) Field of Classification Search
CPC ..... B63B 79/40; B63B 49/00; G05D 1/0206; B63H 25/04; B63H 25/42; B63H 21/21; B63H 2021/216; B63H 2025/045
See application file for complete search history.

(56) References Cited

U.S. PATENT DOCUMENTS

| | | | | |
|---|---|---|---|---|
| 6,788,618 | B2 * | 9/2004 | Clayton | G01V 1/006 367/13 |
| 9,267,340 | B2 * | 2/2016 | Ankargren | B66C 13/02 |
| 11,964,742 | B2 * | 4/2024 | Kadota | B63B 79/40 |
| 11,987,340 | B2 * | 5/2024 | Kadota | G05D 1/2435 |
| 2009/0298359 | A1 | 12/2009 | Hiroshima et al. | |
| 2010/0002536 | A1 * | 1/2010 | Brewer | G01V 1/3817 367/16 |
| 2021/0394877 | A1 | 12/2021 | Kadota et al. | |
| 2023/0059059 | A1 | 2/2023 | Yasui | |

FOREIGN PATENT DOCUMENTS

| | | | |
|---|---|---|---|
| JP | 06-211190 | A | 8/1994 |
| JP | 2001-174275 | A | 6/2001 |
| JP | 2004-239643 | A | 8/2004 |
| JP | 2004-291688 | A | 10/2004 |
| JP | 2023-028939 | A | 3/2023 |
| WO | 2020/235689 | A1 | 11/2020 |

OTHER PUBLICATIONS

Hassani et al., Experimental results on motion regulation in high speed marine vessels, 2014, IEEE, p. 487-492 (Year: 2014).*
Veksler et al., Thrust Allocation With Dynamic Power Consumption Modulation for Diesel-Electric Ships, 2015, IEEE, p. 578-593 ( Year: 2015).*

(Continued)

*Primary Examiner* — Mcdieunel Marc
(74) *Attorney, Agent, or Firm* — Keating & Bennett, LLP

(57) ABSTRACT

A speed control method for a marine vessel includes applying a subtraction process to a throttle opening of a power source of the marine vessel based on a vertical speed of a hull of the marine vessel.

8 Claims, 5 Drawing Sheets

(56) References Cited

OTHER PUBLICATIONS

Hassan et al., A two-fold strategy for designing minimal fuel consumption, superior seakeeping highly maneuverable marine vessels based on ASAP hull technology and Sontag non-linear feedback stabilization, 2009, IEEE, p. 1-8 (Year: 2009).*

Fath-Allah et al., Minimal fuel consumption and highly maneuverable marine vessels design based on ASAP hull technology and sontag non-linear feedback stabilization, 2009, IEEE, p. 1-7 (Year: 2009).*

Bø et al., Marine Vessel and Power Plant System Simulator, 2015, IEEE, p. 2065-2079 (Year: 2015).*

Official Communication issued in corresponding European Patent Application No. 23168455.6, mailed on Sep. 21, 2023.

* cited by examiner

SPEED CONTROL METHOD FOR MARINE VESSEL, AND MARINE VESSEL

CROSS REFERENCE TO RELATED APPLICATIONS

This application claims the benefit of priority to Japanese Patent Application No. 2022-070085, filed on Apr. 21, 2022. The entire contents of this application are hereby incorporated herein by reference.

BACKGROUND OF THE INVENTION

1. Field of the Invention

The present invention relates to a speed control method for a marine vessel navigating in ocean waves, and a marine vessel.

2. Description of the Related Art

In the case that a relatively small marine vessel is navigating in ocean waves, when a marine vessel speed of the marine vessel is increased, a hull of the marine vessel may be subjected to impacts caused by the marine vessel colliding with a wave or the marine vessel landing on the water after riding over the wave. Also, in the case that the marine vessel rides over the wave, the marine vessel speed decreases when the marine vessel rises toward the wave crest, and the marine vessel speed increases when the marine vessel descends toward the trough of the wave. Therefore, the riding comfort of the marine vessel is deteriorated.

Accordingly, techniques for controlling the marine vessel speed in response to a parameter that indicates the behavior of the marine vessel in the ocean waves have been proposed. For example, in a technique described in Japanese Laid-Open Patent Publication (kokai) No. H06-211190, the marine vessel speed is controlled based on an acceleration of the hull in a vertical direction. Specifically, in the case that the acceleration of the hull in the vertical direction exceeds a limit value, a deceleration command is transmitted to a main engine, and the marine vessel speed is reduced to a predetermined value at which the marine vessel will not be damaged.

Furthermore, in a technique described in Japanese Laid-Open Patent Publication (kokai) No. 2004-291688, the marine vessel speed is controlled based on a pitching angular velocity. Specifically, when the pitching angular velocity is positive, since the hull is decelerated in response to the height of the wave, an engine control to accelerate the hull is performed.

However, in the technique described in Japanese Laid-Open Patent Publication (kokai) No. H06-211190, in the case of using a relatively inexpensive acceleration sensor whose data update cycle (whose data obtaining cycle) is not so short, it is not possible to accurately measure a transient characteristic of an acceleration in the vertical direction when an impact has occurred on the hull, and as a result, the marine vessel speed is controlled based on a vertical acceleration that deviates from an actual situation, and the impact may not be appropriately reduced. Furthermore, in the technique described in Japanese Laid-Open Patent Publication (kokai) No. 2004-291688, when the marine vessel rides over the wave, since a damping motion around a pitch axis occurs in the hull, for example, since the damping motion around the pitch axis occurs in the hull even though the marine vessel is descending from the wave crest, the bow may lift, and as a result, the pitching angular velocity may become positive and the hull may be accelerated. That is, the marine vessel that naturally accelerates as it descends from the wave crest may accelerate further. Therefore, there is still room for improvement in the riding comfort of the marine vessel when navigating in the ocean waves.

SUMMARY OF THE INVENTION

Preferred embodiments of the present invention provide speed control methods for marine vessels and marine vessels that are each able to further improve the riding comfort of marine vessels navigating in ocean waves.

According to a preferred embodiment of the present invention, a speed control method for a marine vessel includes applying a subtraction process to a throttle opening of a power source of the marine vessel based on a vertical speed of a hull of the marine vessel.

According to another preferred embodiment of the present invention, a marine vessel includes a controller configured or programmed to control a marine vessel speed of the marine vessel. The controller is configured or programmed to apply a subtraction process to a throttle opening of a power source of the marine vessel based on a vertical speed of a hull of the marine vessel.

According to another preferred embodiment of the present invention, a speed control method for a marine vessel includes controlling a throttle opening based on a vertical speed of a hull of the marine vessel when the marine vessel rides over a wave.

According to preferred embodiments of the present invention, the subtraction process is applied to the throttle opening or the throttle opening is controlled based on the vertical speed of the hull instead of the acceleration of the hull in the vertical direction. Since the vertical speed of the hull is equivalent to the integral of the vertical acceleration of the hull (the acceleration of the hull in the vertical direction), the vertical speed of the hull is easier to be measured than the vertical acceleration of the hull, and it is also possible to accurately measure its transient characteristic. In addition, the vertical speed of the hull will not be reversed when the marine vessel descends from the wave crest. Therefore, since it is possible to accurately determine the behavior of the marine vessel riding over the wave by using the vertical speed of the hull, it is possible to appropriately control the throttle opening so as to reduce or prevent an inappropriate behavior of the marine vessel, and as a result, it is possible to further improve the riding comfort of the marine vessel navigating in the ocean waves.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
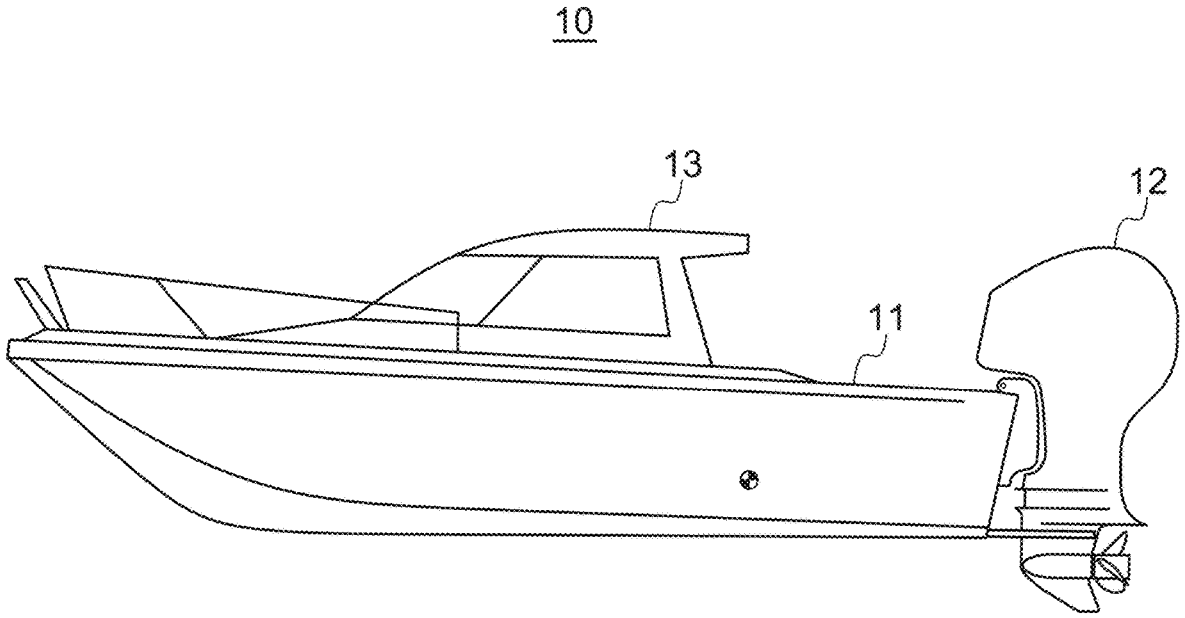
FIG. 1 is a side view of a marine vessel to which a speed control method for a marine vessel according to a preferred embodiment of the present invention is applied.

FIG. 1 is a side view of a marine vessel 10 to which a speed control method for a marine vessel according to a preferred embodiment of the present invention is applied. In FIG. 1, the marine vessel 10 is, for example, a relatively small planing boat, and includes a hull 11 and at least one, for example, two outboard motors 12 that function as propulsion devices and are attached to a stern of the hull 11. Each of the outboard motors 12 generates a propulsive force of the marine vessel 10 by rotating a propeller. In addition, a cabin 13 that also serves as a cockpit is provided on the hull 11.

Figure 2:
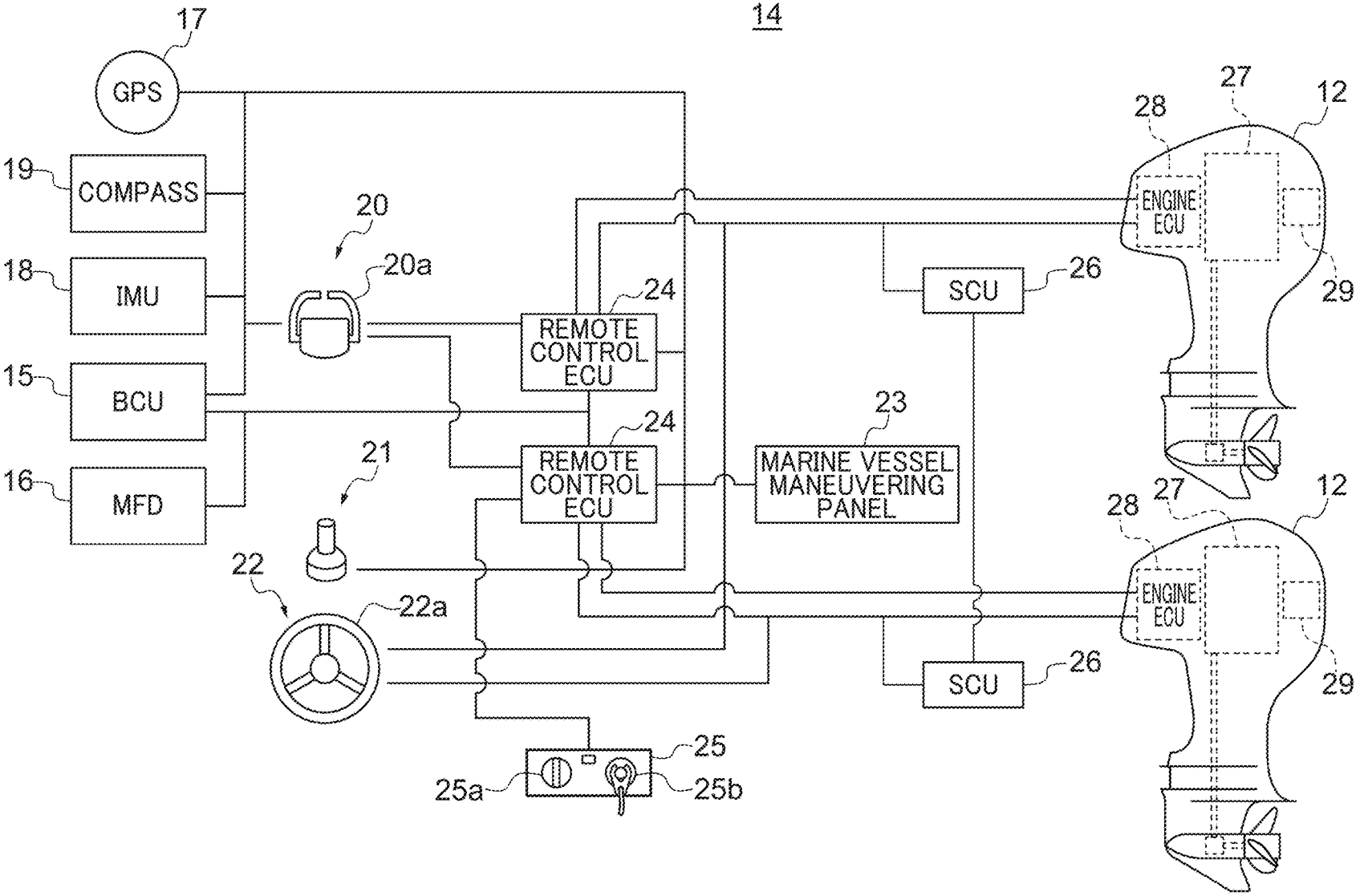
FIG. 2 is a block diagram for schematically explaining a configuration of a marine vessel propulsion control system mounted on the marine vessel shown in FIG. 1.

FIG. 2 is a block diagram for schematically explaining a configuration of a marine vessel propulsion control system 14 mounted on the marine vessel 10 shown in FIG. 1. As shown in FIG. 2, the marine vessel propulsion control system 14 includes the outboard motors 12, a boat control unit (BCU) 15 (functioning as a controller), a multi-function display (MFD) 16, a global positioning system (GPS) 17, an inertial measurement unit (IMU) 18, a compass 19, a remote control unit 20, a joystick 21, a steering mechanism 22, a marine vessel maneuvering panel 23, remote control engine control units (remote control ECUs) 24, a main operation unit 25, and steering control units (SCUs) 26. Respective components of the marine vessel propulsion control system 14 are communicably connected to each other.

The GPS 17 obtains a current position of the marine vessel 10 and transmits the current position of the marine vessel 10 to the BCU 15. The IMU 18 measures the behavior of the hull 11 and transmits the measurement result to the BCU 15. The compass 19 obtains an azimuth of the marine vessel 10 and transmits the azimuth of the marine vessel 10 to the BCU 15.

The remote control unit 20 includes levers 20*a* corresponding to the respective outboard motors 12. By operating each lever 20*a*, a marine vessel user is able to switch an acting direction of the propulsive force generated by the corresponding outboard motor 12 between a forward moving direction and a backward moving direction, and adjust the magnitude of the output of the corresponding outboard motor 12 so as to adjust a marine vessel speed of the marine vessel 10. At this time, the remote control unit 20 transmits a signal to control the outboard motor 12 to the BCU 15 and the remote control ECUs 24 in response to the operation of the lever 20*a*. The joystick 21, which is a control stick to maneuver the marine vessel 10, transmits a signal to move the marine vessel 10 in a tilting direction of the joystick 21 to the BCU 15 and the remote control ECUs 24. The steering mechanism 22 enables the marine vessel user to determine the course of the marine vessel 10. The marine vessel user is able to turn the marine vessel 10 to the left or right by rotatably operating a steering wheel 22*a* of the steering mechanism 22 leftward or rightward. At this time, the steering mechanism 22 transmits a steering angle corresponding to the rotation operation of the steering wheel 22*a* to the remote control ECUs 24 and the SCUs 26.

The main operation unit 25 includes a main switch 25*a* and an engine shutoff switch 25*b*. The main switch 25*a* is an operator to collectively start and stop engines 27 which are power sources of the respective outboard motors 12, and the engine shutoff switch 25*b* is a switch to emergency-stop the engines 27 of the respective outboard motors 12. The MFD 16 includes, for example, a color LCD display, and functions as a display to display various kinds of information and also functions as a touch panel to accept inputs from the marine vessel user. The marine vessel maneuvering panel 23 includes switches (not shown) corresponding to various kinds of marine vessel maneuvering modes. By operating the corresponding switch, the marine vessel user shifts the marine vessel 10 to a desired marine vessel maneuvering mode. Each of the SCUs 26 is provided corresponding to each of the outboard motors 12, and controls a steering unit (not shown), which horizontally turns the corresponding outboard motor 12 with respect to the hull 11 of the marine vessel 10, to change the acting direction of the propulsive force of each of the outboard motors 12.

The BCU 15 obtains the situation of the marine vessel 10 based on signals transmitted from the respective components of the marine vessel propulsion control system 14, determines the magnitude of the propulsive force to be generated by each of the outboard motors 12 and the acting direction of the propulsive force to be taken, and transmits the result of the determination to each of the remote control ECUs 24. One remote control ECU 24 is provided corresponding to each of the outboard motors 12. In response to signals transmitted from the BCU 15, the steering mechanism 22, the remote control unit 20, the joystick 21, etc., each of the remote control ECUs 24 transmits signals to control the engine 27 of each of the outboard motors 12 and the steering unit to an engine ECU 28 of each of the outboard motors 12 and the SCU 26, and adjusts the magnitude and the acting direction of the propulsive force of each of the outboard motors 12.

The engine ECU 28 of each of the outboard motors 12 adjusts an opening of a throttle valve 29 of the engine 27 based on a throttle opening command value, which is one of the signals transmitted from the remote control ECU 24. It should be noted that the BCU 15 executes the speed control method for the marine vessel according to the present preferred embodiment of the present invention.

In the speed control method for the marine vessel according to the present preferred embodiment, since the main purpose is to reduce the impact caused by the marine vessel 10 landing on the water after riding over the wave, the marine vessel speed of the marine vessel 10 is decreased when the marine vessel 10 rides over the wave. In addition, since the behavior of the marine vessel 10 changes when the marine vessel 10 rides over the wave, in order to appropriately perform the impact reduction at the time of landing on the water due to the decrease in the marine vessel speed (deceleration), it is necessary to accurately obtain the behavior of the marine vessel 10 in the ocean waves.

As a parameter that indicates the behavior of the marine vessel 10 in the ocean waves, an acceleration in a vertical direction of the hull 11 (hereinafter, referred to as "a vertical acceleration"), a pitching angular velocity of the hull 11, or a speed in the vertical direction of the hull 11 (hereinafter, referred to as "a vertical speed") can be considered. However, when the marine vessel 10 rides over the wave, since a damping motion around a pitch axis occurs in the hull 11, the pitching angular velocity is affected not only by a posture change of the hull 11 directly caused by the wave, but also by the damping motion around the pitch axis. For example, the bow may lift due to the damping motion around the pitch axis during descent from the wave crest where the pitching angular velocity should normally be negative, and as a result, the pitching angular velocity may become positive. Therefore, the pitching angular velocity may not be optimal as the parameter that indicates the behavior of the marine vessel 10 in the ocean waves.

In addition, since the impact at the time of landing on the water is represented by a multiple of the acceleration, in a control to reduce the impact applied to the hull 11 (hereinafter, referred to as "a posture control"), it is considered natural to use the vertical acceleration of the hull 11 as a physical quantity.

Figure 3:
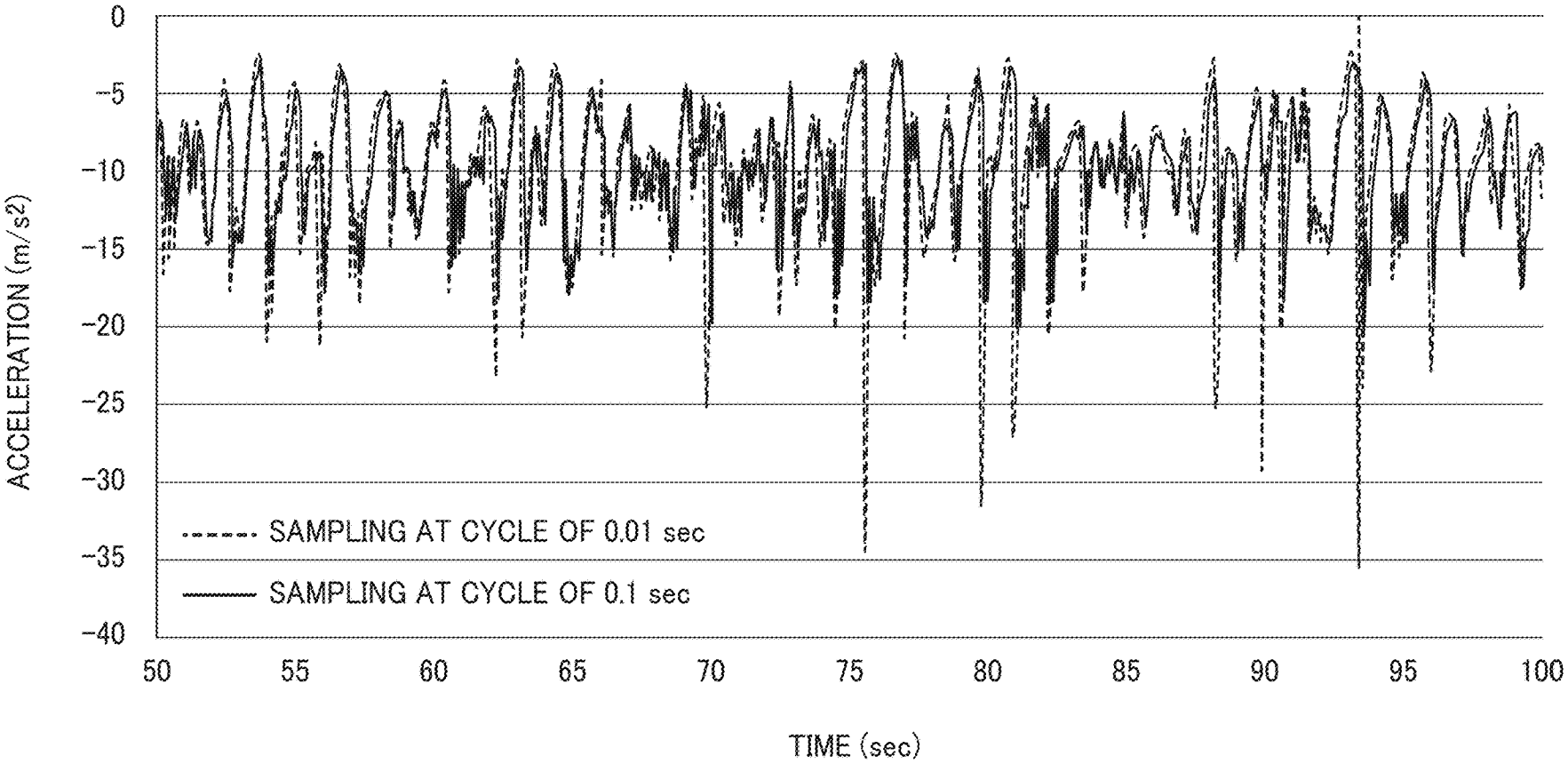
FIG. 3 is a diagram for explaining how a vertical acceleration of a hull varies.

However, for the relatively small marine vessel 10, since the vertical acceleration of the hull 11 finely varies in a very fast cycle, it is difficult for the IMU 18 to accurately measure the vertical acceleration of the hull 11. For example, FIG. 3 shows a measurement result of the vertical acceleration in the case that the vertical acceleration of the hull 11 of the marine vessel 10 navigating in the ocean waves is sampled at a cycle of 0.1 seconds (indicated by a solid line), and a measurement result of the vertical acceleration in the case that the same vertical acceleration is sampled at a cycle of 0.01 seconds (indicated by a broken line). Comparing these measurement results with each other, it can be seen that a steep change in the vertical acceleration, which is measurable in the case that sampling is performed at the cycle of 0.01 seconds, becomes unmeasurable in the case that sampling is performed at the cycle of 0.1 seconds. In addition, since a sampling rate of the IMU 18 is generally 0.05 seconds, it is not possible for the IMU 18 to accurately measure a steep change in the vertical acceleration of the hull 11. Therefore, in the case of using the vertical acceleration of the hull 11 measured by the IMU 18, the posture control will be performed based on the vertical acceleration that deviates from the actual situation, and there is a possibility that it is not possible to appropriately perform the impact reduction at the time of landing on the water.

On the other hand, since the vertical speed of the hull 11 is equivalent to the integral of the vertical acceleration of the hull 11, unlike the vertical acceleration of the hull 11, a steep change in the vertical speed of the hull 11 does not occur, and it is possible to accurately measure the change in the vertical speed of the hull 11 even by the IMU 18. In addition, since the vertical speed of the hull 11 is obtained by integrating the vertical acceleration of the hull 11, as a result, the vertical speed of the hull 11 will reflect the steep change in the vertical acceleration. Therefore, in the case of using the vertical speed of the hull 11, it is possible to perform the posture control based on a parameter that does not deviate from the actual situation. Therefore, in a preferred embodiment of the present invention, the posture control is performed by using the vertical speed of the hull 11, which functions as an index of the impact applied to the hull 11, instead of the vertical acceleration of the hull 11.

Figure 4:
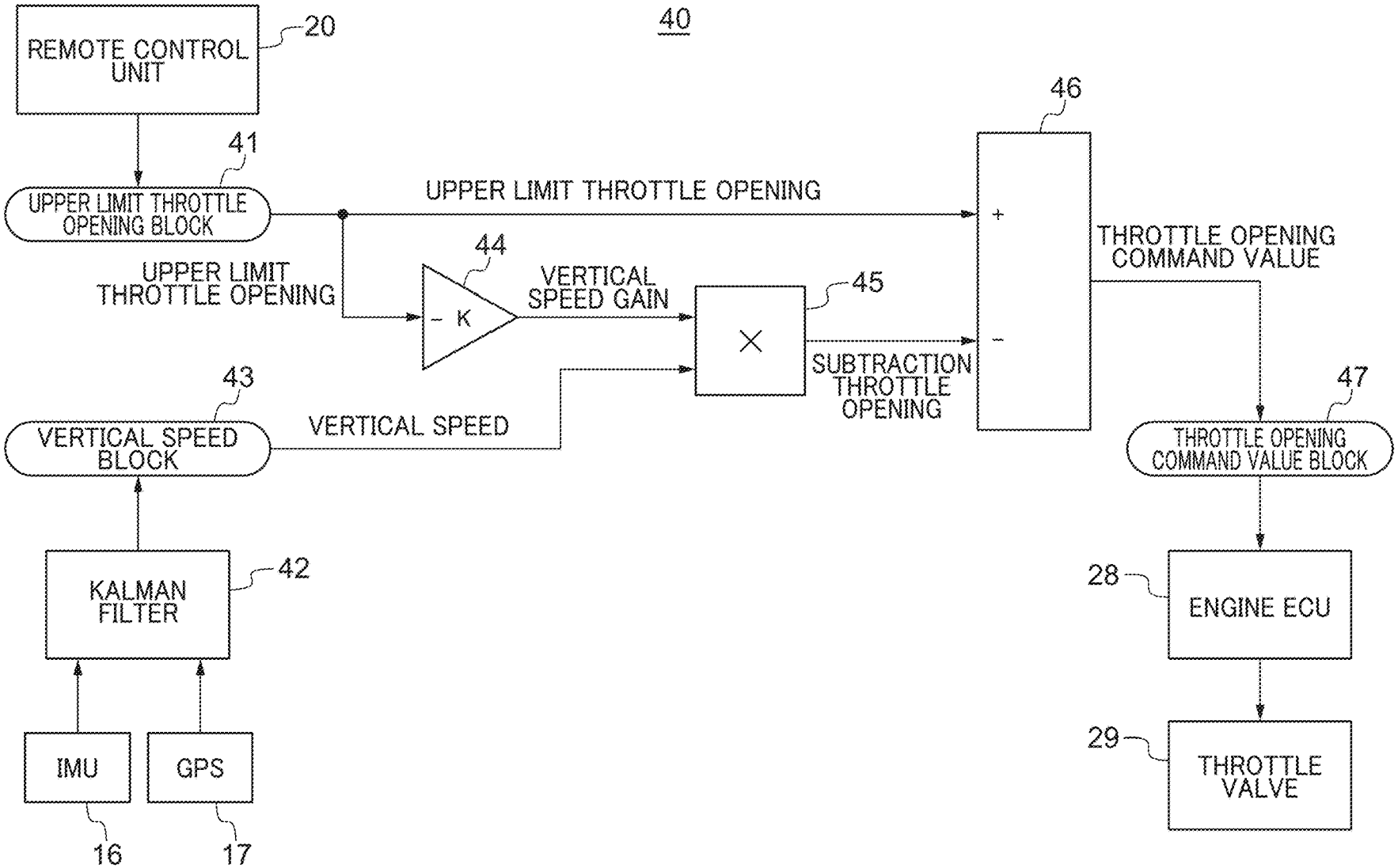
FIG. 4 is a block diagram of a posture control controller that is implemented by the speed control method for the marine vessel according to a preferred embodiment of the present invention.

FIG. 4 shows a block diagram of a posture control controller 40 that is implemented by the speed control method according to the present preferred embodiment. In the present preferred embodiment, the posture control controller 40 shown in FIG. 4 controls the opening of the throttle valve 29 (hereinafter, simply referred to as "a throttle opening") based on the vertical speed of the marine vessel 10 (the vertical speed of the hull 11).

As shown in FIG. 4, the posture control controller 40 includes an upper limit throttle opening block 41, a Kalman filter 42, a vertical speed block 43, a coefficient multiplier 44, a gain multiplier 45, a subtractor 46, and a throttle opening command value block 47. It should be noted that the posture control controller 40 is implemented in the BCU 15.

In the posture control controller 40, first, based on the signal transmitted from the remote control unit 20, the upper limit throttle opening block 41 sets the throttle opening designated by the marine vessel user using the lever 20*a* as an upper limit throttle opening. In addition, the upper limit throttle opening block 41 transmits the upper limit throttle opening to the coefficient multiplier 44 and the subtractor 46.

The Kalman filter 42 estimates the vertical speed of the marine vessel 10 based on the measurement results of the behavior of the marine vessel 10 transmitted from the IMU 18 and the GPS 17, and the vertical speed block 43 transmits the estimated vertical speed to the gain multiplier 45. The coefficient multiplier 44 calculates a vertical speed gain (a predetermined gain) by multiplying the upper limit throttle opening by a vertical speed gain coefficient, and transmits the calculated vertical speed gain to the gain multiplier 45. It should be noted that in the present preferred embodiment, "−K", which is a negative value, is set as the vertical speed gain coefficient with reference to a return amount of the throttle opening at the time of riding over the wave of the marine vessel performed by a veteran marine vessel user. However, the vertical speed gain coefficient is not limited to this value "−K", and may be changed in response to the specifications of the marine vessel 10, the sea conditions, and/or the marine vessel user's preference.

The gain multiplier 45 calculates a subtraction throttle opening by multiplying the vertical speed by the vertical speed gain, and transmits the calculated subtraction throttle opening to the subtractor 46. The subtractor 46 calculates the throttle opening command value by subtracting the subtraction throttle opening from the upper limit throttle opening, and the throttle opening command value block 47 transmits the calculated throttle opening command value to the engine ECU 28 of each of the outboard motors 12. Each engine ECU 28 controls the opening of the throttle valve 29 based on the throttle opening command value to adjust the marine vessel speed of the marine vessel 10.

That is, in the posture control controller 40, although the opening of the throttle valve 29 is controlled based on the throttle opening command value, which is obtained by applying a subtraction process to the upper limit throttle opening by using the subtraction throttle opening, since the subtraction throttle opening is obtained by multiplying the vertical speed by the vertical speed gain, for example, as the marine vessel 10 rides over a large wave and the vertical speed of the hull 11 increases, the subtraction throttle opening increases and, as a result, the throttle opening command value decreases. That is, as the vertical speed of the hull 11 increases, the throttle opening command value decreases and the opening of the throttle valve 29 decreases, so the marine vessel speed of the marine vessel 10 decreases. As a result, it is possible to reduce the impact caused by the marine vessel 10 landing on the water after riding over the wave.

Generally, in a motion coordinate system of the marine vessel 10, since the downward direction is positive with respect to the vertical direction, when the marine vessel 10 rides over the wave, the vertical speed becomes a negative value. Furthermore, as in a preferred embodiment of the present invention, in the case that a negative value is set as the vertical speed gain coefficient, when the marine vessel 10 rides over the wave, the subtraction throttle opening obtained by multiplying the vertical speed by the vertical speed gain coefficient becomes a positive value. In addition, in a preferred embodiment of the present invention, since the throttle opening command value is calculated by subtracting the subtraction throttle opening, which is a positive value, from the upper limit throttle opening, in the case that the marine vessel 10 rides over the wave, the throttle opening command value becomes smaller than the upper limit throttle opening. As a result, the opening of the throttle valve 29 is decreased, and the marine vessel speed of the marine vessel 10 decreases.

On the other hand, when the marine vessel 10 descends from the wave crest, the vertical speed becomes a positive value. Therefore, when the marine vessel 10 descends from the wave crest, the subtraction throttle opening obtained by multiplying the vertical speed by the vertical speed gain coefficient becomes a negative value. In addition, since the throttle opening command value is calculated by subtracting the subtraction throttle opening, which is a negative value, from the upper limit throttle opening, when the marine vessel 10 descends from the wave crest, the throttle opening command value becomes larger than the upper limit throttle opening. As a result, the opening of the throttle valve 29 is increased, and the marine vessel speed of the marine vessel 10 increases. That is, in a preferred embodiment of the present invention, since the marine vessel speed of the marine vessel 10 increases when the marine vessel 10 descends from the wave crest, it is possible to recover the marine vessel speed that has been reduced in order to reduce the impact caused by landing on the water, and it is possible to prevent a delay in arrival at the destination of the marine vessel 10.

In addition, in the case of obtaining the throttle opening command value, when the subtraction throttle opening is constant, the marine vessel 10 is excessively decelerated when the marine vessel speed is low while the marine vessel 10 cannot be sufficiently decelerated when the marine vessel speed is high. In particular, in the latter case, it is not possible to sufficiently reduce the impact caused by the marine vessel 10 landing on the water after riding over the wave.

Therefore, in a preferred embodiment of the present invention, the vertical speed gain for obtaining the subtraction throttle opening is calculated by multiplying the upper limit throttle opening by the vertical speed gain coefficient. As a result, the subtraction throttle opening changes in response to the upper limit throttle opening. Specifically, when the upper limit throttle opening is large (that is, when the marine vessel speed is high), since the subtraction throttle opening becomes large and the throttle opening command value is largely subtracted, the marine vessel 10 is sufficiently decelerated. As a result, it is possible to sufficiently reduce the impact caused by the marine vessel 10 landing on the water after riding over the wave. Moreover, when the upper limit throttle opening is small (that is, when the marine vessel speed is low), the subtraction throttle opening becomes small, and excessive deceleration of the marine vessel 10 is reduced or prevented. As a result, it is possible to prevent a significant delay in arrival at the destination of the marine vessel 10.

Even in the case that the vertical speed gain is calculated by multiplying the marine vessel speed by the vertical speed gain coefficient instead of the upper limit throttle opening, when the marine vessel speed is high, it is possible to sufficiently decelerate the marine vessel 10 by increasing the subtraction throttle opening. Therefore, it is also conceivable to calculate the vertical speed gain by using the marine vessel speed instead of the upper limit throttle opening. However, since the marine vessel speed changes as a result when the posture control is executed and the marine vessel speed changes even if an external disturbance is applied to the marine vessel 10, the deceleration gain calculated by using the marine vessel speed becomes unstable, and as a result, there is a possibility that the posture control is unstable.

Therefore, in a preferred embodiment of the present invention, as described above, the vertical speed gain is calculated by using the upper limit throttle opening instead of the marine vessel speed. For example, even in the case that the posture control is executed or in the case that an external disturbance is applied to the marine vessel 10, in principle, since the marine vessel user does not change the operation amount of the lever 20*a*, the deceleration gain calculated by using the upper limit throttle opening is stable, and as a result, it is possible to stabilize the posture control. Moreover, since the vertical speed gain is calculated by multiplying the upper limit throttle opening by the vertical speed gain coefficient, the vertical speed gain is proportional to the upper limit throttle opening.

In addition, in the case that regardless of the magnitude of the vertical speed of the hull 11, when the marine vessel 10 rides over the wave, the subtraction throttle opening is subtracted from the upper limit throttle opening, the acceleration and deceleration of the marine vessel 10 are repeated each time the marine vessel 10 encounters a wave, which is not preferable from the viewpoint of improving the riding comfort. Furthermore, there is a possibility that the average marine vessel speed will unnecessarily decrease and the arrival of the marine vessel 10 at its destination will be delayed.

Therefore, in the posture control controller 40, when the vertical speed of the hull 11 is equal to or lower than a vertical speed threshold (a predetermined vertical speed), the vertical speed block 43 sets the vertical speed to 0 regardless of the estimation performed by the Kalman filter 42. As an example, the predetermined vertical speed is within 0.1 to 0.5 [m/s]. As a result, the subtraction throttle opening becomes 0, the upper limit throttle opening is not subtracted, and the marine vessel speed of the marine vessel 10 does not change. As a result, repetition of the acceleration and deceleration of the marine vessel 10 is reduced or prevented to further improve the riding comfort, and it is possible to prevent the delay in arrival at the destination of the marine vessel 10 by reducing or preventing the average marine vessel speed from decreasing unnecessarily.

Moreover, when the vertical speed of the hull 11 is higher than the vertical speed threshold, since the vertical speed block 43 transmits the vertical speed estimated by the Kalman filter 42 to the gain multiplier 45, the subtraction throttle opening does not become 0, the upper limit throttle opening is subtracted, and the marine vessel speed of the marine vessel 10 decreases.

In addition, although not applying the subtraction process to the upper limit throttle opening when the vertical speed of the hull 11 is equal to or lower than the vertical speed threshold, is nothing other than tolerating the impact caused by landing on the water to some extent, impact tolerance varies by the marine vessel user. Therefore, the marine vessel 10 may be configured so that the vertical speed threshold is able to be arbitrarily set in response to the preference of the marine vessel user. In this case, for example, the MFD 16 may be configured so that the marine vessel user is able to input an arbitrary vertical speed threshold, or the MFD 16 may be configured to display a plurality of options for the vertical speed threshold so that the marine vessel user is able to select a desired vertical speed threshold. In the case that the marine vessel user prioritizes reducing or preventing a decrease in the average marine vessel speed over improving the riding comfort, the vertical speed threshold is set high, and on the other hand, in the case that the marine vessel user prioritizes improving the riding comfort over reducing or preventing a decrease in the average marine vessel speed, the vertical speed threshold is set low.

Moreover, in the case that the vertical speed is denoted as Vz, the vertical speed threshold is denoted as Vz threshold, and the vertical speed gain is denoted as Vz gain, the posture control controller 40, for which the vertical speed threshold is set, can be expressed programmatically as the following Expression 1.

$$Vz\ \text{gain}=(-K)\times\text{upper limit throttle opening(deg)} \qquad \text{Expression 1}$$

if Vz threshold<Vz then

Vz:=0 end if throttle opening command value(deg)=max[upper limit throttle opening(deg)−max[Vz gain×Vz(m/s),0],0]

Figure 5A:
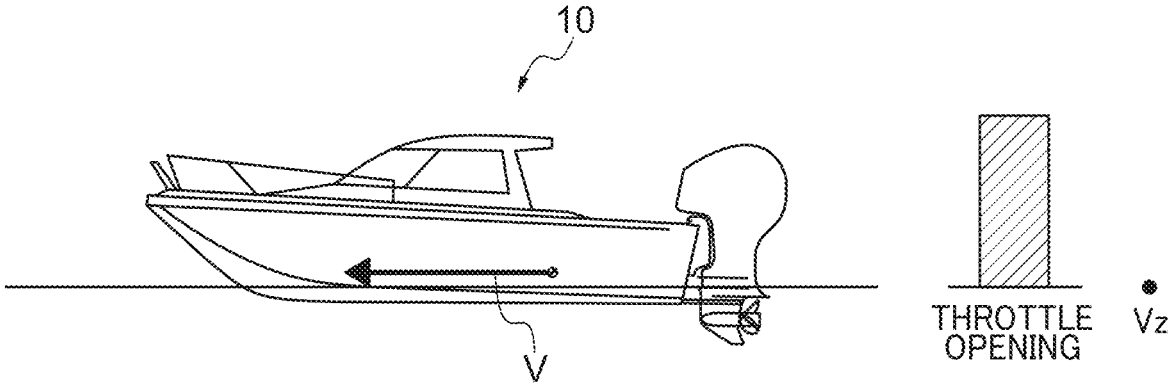
FIGS. 5A to 5C are diagrams for explaining how a posture control is performed in a preferred embodiment of the present invention.
Figure 5B:
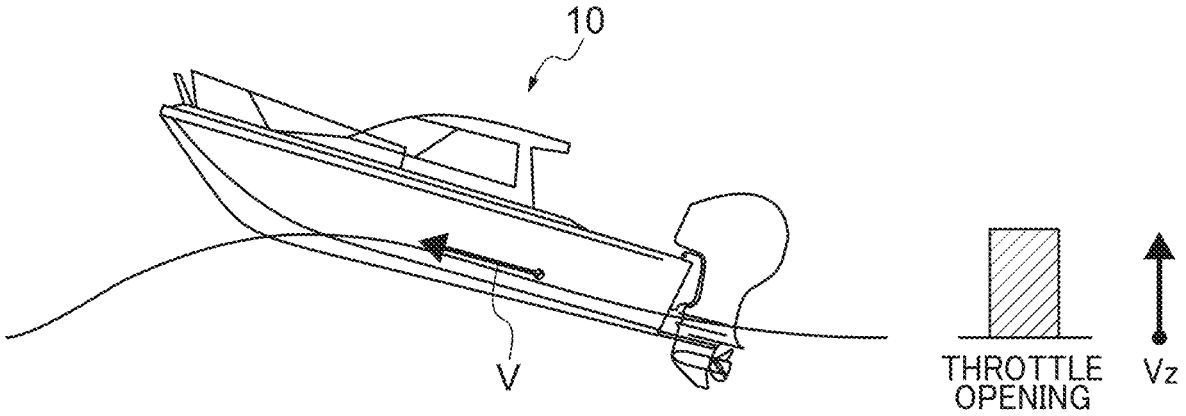
Figure 5C:
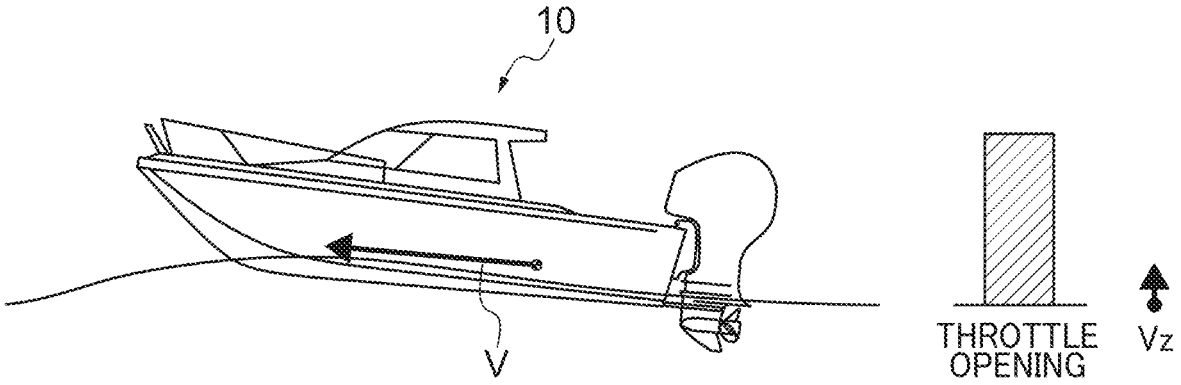

FIGS. 5A to 5C are diagrams for explaining how the posture control is performed in a preferred embodiment of the present invention. As shown in FIG. 5A, when the marine vessel 10 is not riding over the wave, since the vertical speed Vz of the hull 11 is approximately 0, in the posture control controller 40, the subtraction throttle opening is also approximately 0, and the upper limit throttle opening is not subtracted. As a result, since the throttle opening command value is maintained at the upper limit throttle opening and the throttle opening does not decrease, a marine vessel speed V, which is the speed in the traveling direction of the marine vessel 10, is also maintained.

On the other hand, as shown in FIG. 5B, when the marine vessel 10 rides over a relatively large wave and the vertical speed Vz of the hull 11 becomes larger than the vertical speed threshold, in the posture control controller 40, the subtraction throttle opening becomes a magnitude corresponding to the vertical speed Vz, and the upper limit throttle opening is subtracted. As a result, since the throttle opening command value decreases from the upper limit throttle opening and the throttle opening also decreases, the marine vessel speed V of the marine vessel 10 also decreases. As a result, it is possible to sufficiently reduce the impact caused by the marine vessel 10 landing on the water after riding over the wave.

Further, as shown in FIG. 5C, when the marine vessel 10 rides over a relatively small wave and the vertical speed Vz of the hull 11 remains equal to or lower than the vertical speed threshold, as described above, since the vertical speed block 43 sets the vertical speed to 0, the subtraction throttle opening becomes 0, and the upper limit throttle opening is not subtracted. As a result, since the throttle opening command value is maintained at the upper limit throttle opening and the throttle opening does not decrease, the marine vessel speed V, which is the speed in the traveling direction of the marine vessel 10, is also maintained.

According to a preferred embodiment of the present invention, in the posture control, the subtraction throttle opening, which is calculated based on the vertical speed of the hull 11 instead of the vertical acceleration of the hull 11, is subtracted from the upper limit throttle opening. Since the vertical speed of the hull 11 is equivalent to the integral of the vertical acceleration of the hull 11, the vertical speed of the hull 11 is easier to be measured than the vertical acceleration of the hull 11, and it is also possible to accurately measure its transient characteristic such as a steep change. In addition, the vertical speed of the hull 11 will not be reversed when the marine vessel 10 descends from the wave crest. Therefore, since it is possible to accurately determine the behavior of the marine vessel 10 riding over the wave by using the vertical speed of the hull 11, it is possible to appropriately control the throttle opening so as to reduce or prevent the inappropriate behavior of the marine vessel 10, and as a result, it is possible to further improve the riding comfort of the marine vessel 10 navigating in the ocean waves.

In addition, in a preferred embodiment of the present invention, since the subtraction throttle opening changes in response to both the vertical speed of the hull 11 and the upper limit throttle opening, for example, even in the case that the marine vessel speed of the marine vessel 10 is low, but the marine vessel 10 rides over a relatively large wave and the vertical speed of the hull 11 increases, or in the case that the marine vessel 10 rides over a wave that is not so large, and the vertical speed of the hull 11 is not so large, but the marine vessel speed of the marine vessel 10 is high, it is possible to appropriately lower the throttle opening command value, and it is possible to reliably improve the riding comfort of the marine vessel 10.

In addition, in a preferred embodiment of the present invention, when the marine vessel 10 rides over the wave, since the posture control controller 40 decreases the throttle opening command value to reduce the marine vessel speed V of the marine vessel 10 even if the marine vessel user does not move the lever 20*a* of the remote control unit 20, even if the marine vessel user is a beginner and is not accustomed to operating the lever 20*a* when the marine vessel 10 rides over the wave, it is possible to sufficiently reduce the impact caused by landing on the water.

When determining the throttle opening command value in the posture control, referencing many parameters may cause the control to become complicated and diverge. On the other hand, in the posture control in a preferred embodiment of the present invention, since only the vertical speed of the marine vessel 10 and the upper limit throttle opening are used as parameters, the control is simple, and it is possible to reduce or prevent the divergence of the control.

Although preferred embodiments of the present invention have been described above, the present invention is not limited to the preferred embodiments described above, and various modifications and changes can be made within the scope of the gist of the present invention.

For example, although the marine vessel 10 to which a speed control method is applied is a relatively small planing boat, the speed control method may be applied to a relatively small displacement type marine vessel or a hydrofoil marine vessel. In addition, although the power source of the outboard motor 12 is the engine, the outboard motor 12 may include an electric motor as the power source instead of the engine, or may include both the engine and the electric motor. Furthermore, in the case that the outboard motor 12 includes an electric motor as the power source, the posture control controller 40 applies the subtraction process based on command values of a voltage applied to the electric motor and a current flowing instead of the throttle opening. Moreover, although the marine vessel 10 includes the outboard motors 12, the marine vessel 10 may include inboard motors or inboard/outboard motors instead of the outboard motors 12.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A speed control method for a marine vessel, the speed control method comprising:

applying a subtraction process to a throttle opening of a power source of the marine vessel based on a vertical speed of a hull of the marine vessel.

2. The speed control method according to claim 1, wherein in the subtraction process, a value obtained by multiplying the vertical speed of the hull by a predetermined gain is subtracted from the throttle opening designated by a marine vessel user.

3. The speed control method according to claim 2, wherein the predetermined gain is proportional to the throttle opening designated by the marine vessel user.

4. The speed control method according to claim 1, wherein, when the vertical speed of the hull is equal to or lower than a predetermined vertical speed, the subtraction process is not applied to the throttle opening.

5. The speed control method according to claim 4, wherein the predetermined vertical speed is able to be arbitrarily set by a marine vessel user.

6. The speed control method according to claim 1, further comprising:

estimating the vertical speed of the hull by using a Kalman filter based on a behavior of the hull.

7. A marine vessel comprising:

a controller configured or programmed to control a marine vessel speed of the marine vessel; wherein the controller is configured or programmed to apply a subtraction process to a throttle opening of a power source of the marine vessel based on a vertical speed of a hull of the marine vessel.

8. A speed control method for a marine vessel, the speed control method comprising:

controlling a throttle opening based on a vertical speed of a hull of the marine vessel when the marine vessel rides over a wave.

* * * * *